US008115395B2

(12) United States Patent
Horng et al.

(10) Patent No.: US 8,115,395 B2
(45) Date of Patent: Feb. 14, 2012

(54) SELF-DUSTING LAMP DEVICE

(75) Inventors: Alex Horng, Kaohsiung (TW); Masaharu Miyahara, Kaohsiung (TW); Heng-Yu Hu, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 377 days.

(21) Appl. No.: 12/407,306

(22) Filed: Mar. 19, 2009

(65) Prior Publication Data

US 2010/0237782 A1 Sep. 23, 2010

(30) Foreign Application Priority Data

Sep. 15, 2008 (TW) ..... 97135371 A

(51) Int. Cl.
*H01J 13/32* (2006.01)
*F21V 29/00* (2006.01)

(52) U.S. Cl. ..... 315/117; 315/118; 362/294

(58) Field of Classification Search ..... 362/264, 362/294, 373; 315/112, 117, 118, 291
See application file for complete search history.

(56) References Cited

U.S. PATENT DOCUMENTS

| | | | | |
|---|---|---|---|---|
| 6,787,999 | B2 * | 9/2004 | Stimac et al. | 315/51 |
| 6,974,233 | B1 * | 12/2005 | Aubrey | 362/294 |
| 7,144,140 | B2 * | 12/2006 | Sun et al. | 362/373 |
| 7,524,089 | B2 * | 4/2009 | Park | 362/294 |
| 7,670,028 | B2 * | 3/2010 | Liu et al. | 362/294 |
| 2004/0105264 | A1 * | 6/2004 | Spero | 362/276 |
| 2005/0128752 | A1 * | 6/2005 | Ewington et al. | 362/294 |
| 2007/0201236 | A1 | 8/2007 | Craw et al. | |
| 2009/0052175 | A1 | 2/2009 | Xu et al. | |

* cited by examiner

*Primary Examiner* — Tung X Le
(74) *Attorney, Agent, or Firm* — Muncy, Geissler, Olds & Lowe, PLLC

(57) ABSTRACT

A self-dusting lamp device includes a housing, a heat-dissipating module, a lighting element and a controlling unit. The housing has an air inlet portion and an air outlet portion on the outer periphery thereof. The heat-dissipating module has a heat-dissipating fan mounted in the housing. The lighting element is coupled to the heat-dissipating module for illumination. The controlling unit has a driving circuit electrically connected to the heat-dissipating fan and a direction controlling circuit electrically connected to the driving circuit. The direction controlling circuit controls the heat-dissipating fan to rotate in a normal direction for dissipating heat or to rotate in a dusting direction for dusting down the housing through the driving circuit.

8 Claims, 3 Drawing Sheets

SELF-DUSTING LAMP DEVICE

BACKGROUND OF THE INVENTION

1. Field of the Invention

The present invention relates to a lamp device and, more particularly, to a self-dusting lamp device for being dusted down automatically.

2. Description of the Related Art

Generally, a conventional lamp device, such as the one disclosed in Taiwan Utility Model Publication No. M334919 entitled "Improved LED lamp structure", includes a housing, a heat-dissipating seat, a heat-dissipating fan, and a shock absorber. The housing has a plurality of air inlets and a plurality of air outlets, and a LED substrate is mounted in the housing. The heat-dissipating seat is mounted in the housing and abuts against the LED substrate. The heat-dissipating fan is mounted on a side of the heat-dissipating seat through the shock absorber.

In use, the conventional lamp device is coupled to a socket on a wall, a ceiling or a table (not illustrated) for being supplied with electricity and providing illumination. Moreover, the LED substrate is supplied with electricity to emit light and thus generates undesired heat; in the meanwhile, by the heat-dissipating fan, air is drawn into an interior of the housing from an exterior thereof via the air inlet and then exhausted back to the exterior via the air outlet, so as to form air currents passing through the housing. Thereby, through the heat conducting effect of the heat-dissipating seat, the undesired heat is transferred to the environment by the air currents. Consequently, the conventional lamp device provides heat-dissipating effect and, thus, the life of the conventional lamp device is longer than those of lamps without a heat-dissipating function.

However, when the air flows into the interior via the air inlets by the heat-dissipating fan, dust accompanying the air is liable to accumulate gradually around the air inlets. After a long time of use, the air inlets are liable to be clogged with dust, and the clogged air inlets may adversely decrease an amount of input air, and reduce the heat-dissipating effect and shorten the life of the conventional lamp device.

SUMMARY OF THE INVENTION

The primary objective of the present invention is to provide a self-dusting lamp device for being dusting down automatically, avoiding user's inconvenience of dusting down the conventional lamp device regularly and manually.

A self-dusting lamp device according to the preferred teachings of the present invention includes a housing having an electrical connection portion on an end thereof and a light penetrating portion on the other end thereof. The housing further has an air inlet portion and an air outlet portion on the outer periphery thereof. A heat-dissipating module mounted in the housing has a heat-dissipating fan. A lighting element is coupled to the heat-dissipating module and electrically connected to the electrical connection portion. A controlling unit has a driving circuit electrically connected to the heat-dissipating fan and a direction controlling circuit electrically connected to the driving circuit. The direction controlling circuit controls the heat-dissipating fan to rotate in a normal direction or in a dusting direction via the driving circuit. Accordingly, the heat-dissipating fan rotates in the normal direction for providing the heat-dissipating effect, and the heat-dissipating fan rotates in the dusting direction for providing automatically self-dusting effect, for prolonging the life of the self-dusting lamp device.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
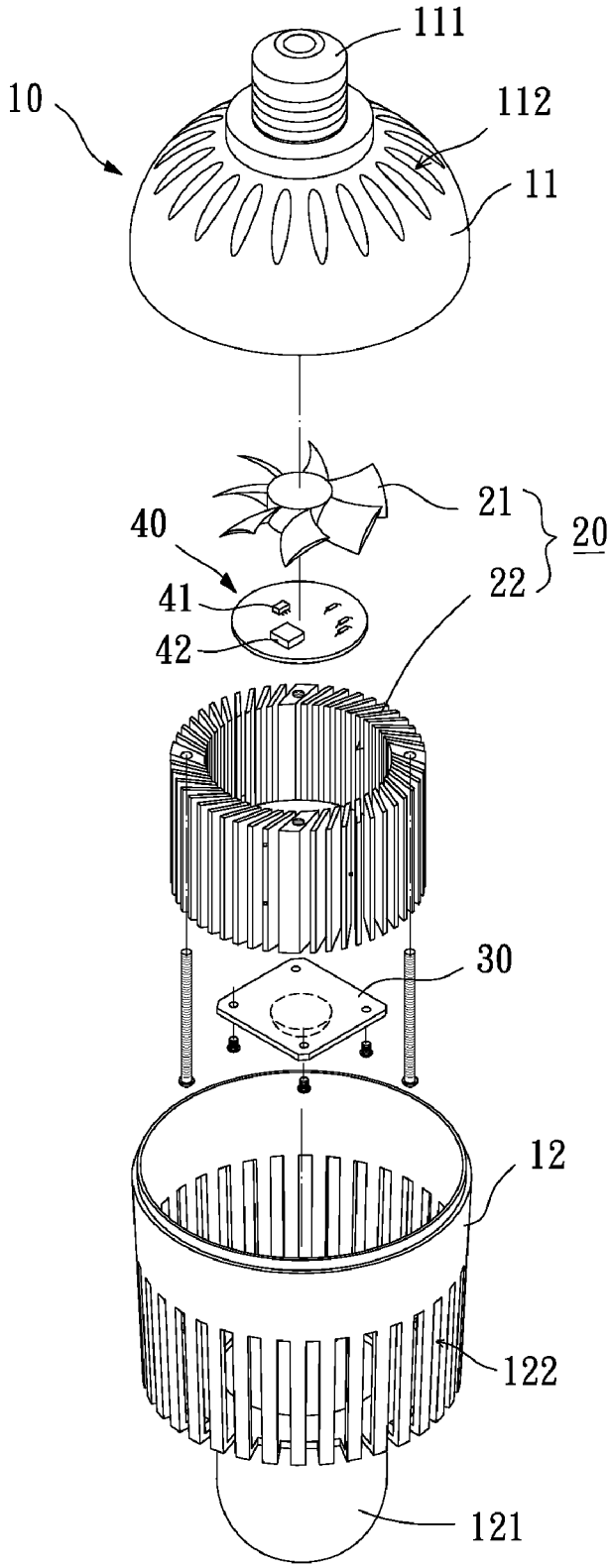
FIG. 1 shows an exploded, perspective view of a self-dusting lamp device according to the preferred teachings of the present invention.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "end", "portion", "axial", "opening", "circumferential", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 2:
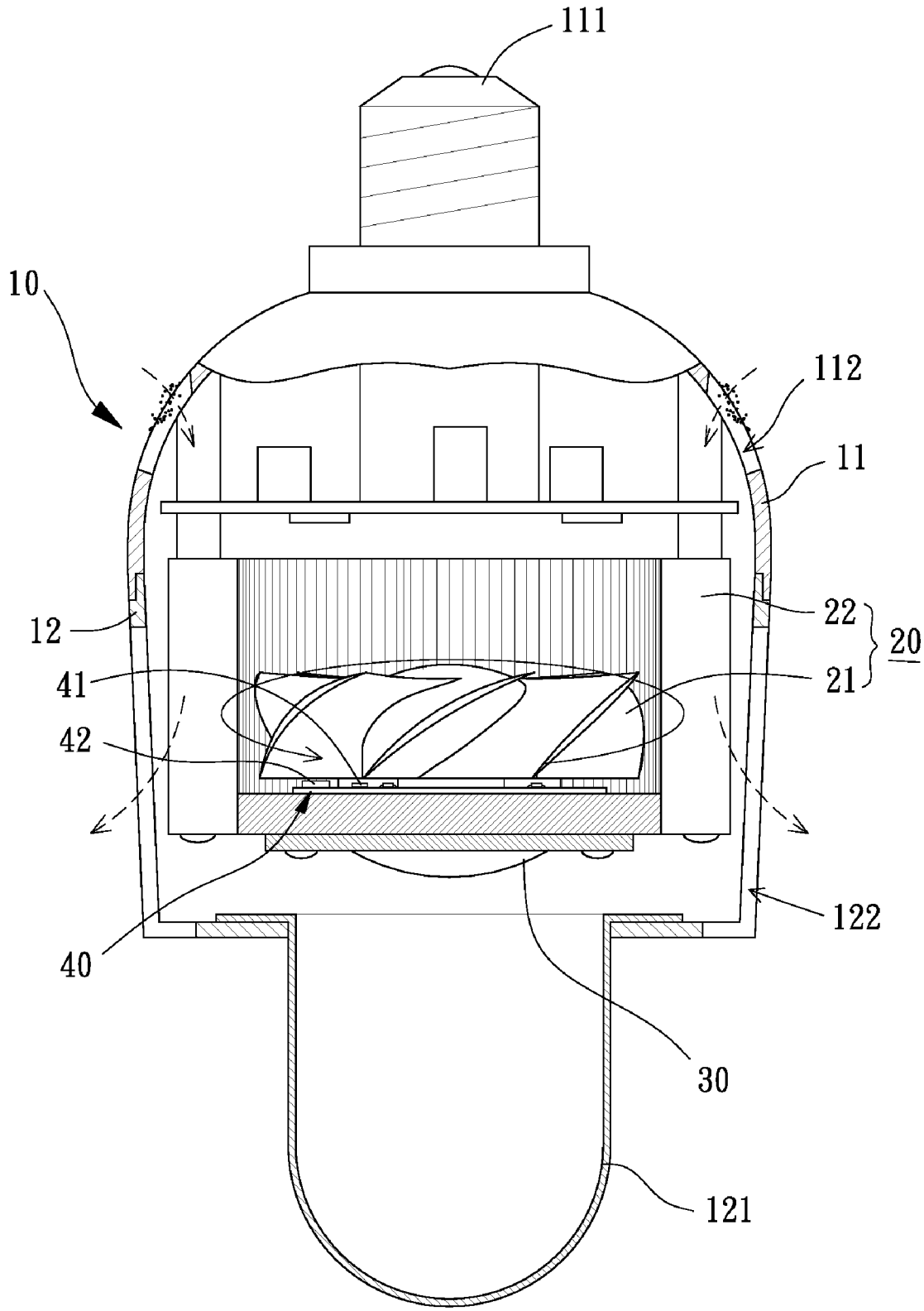
FIG. 2 shows a cross sectional view of the self-dusting lamp device of FIG. 1, illustrating the heat-dissipating fan rotating in a normal direction for dissipating heat.
Figure 3:
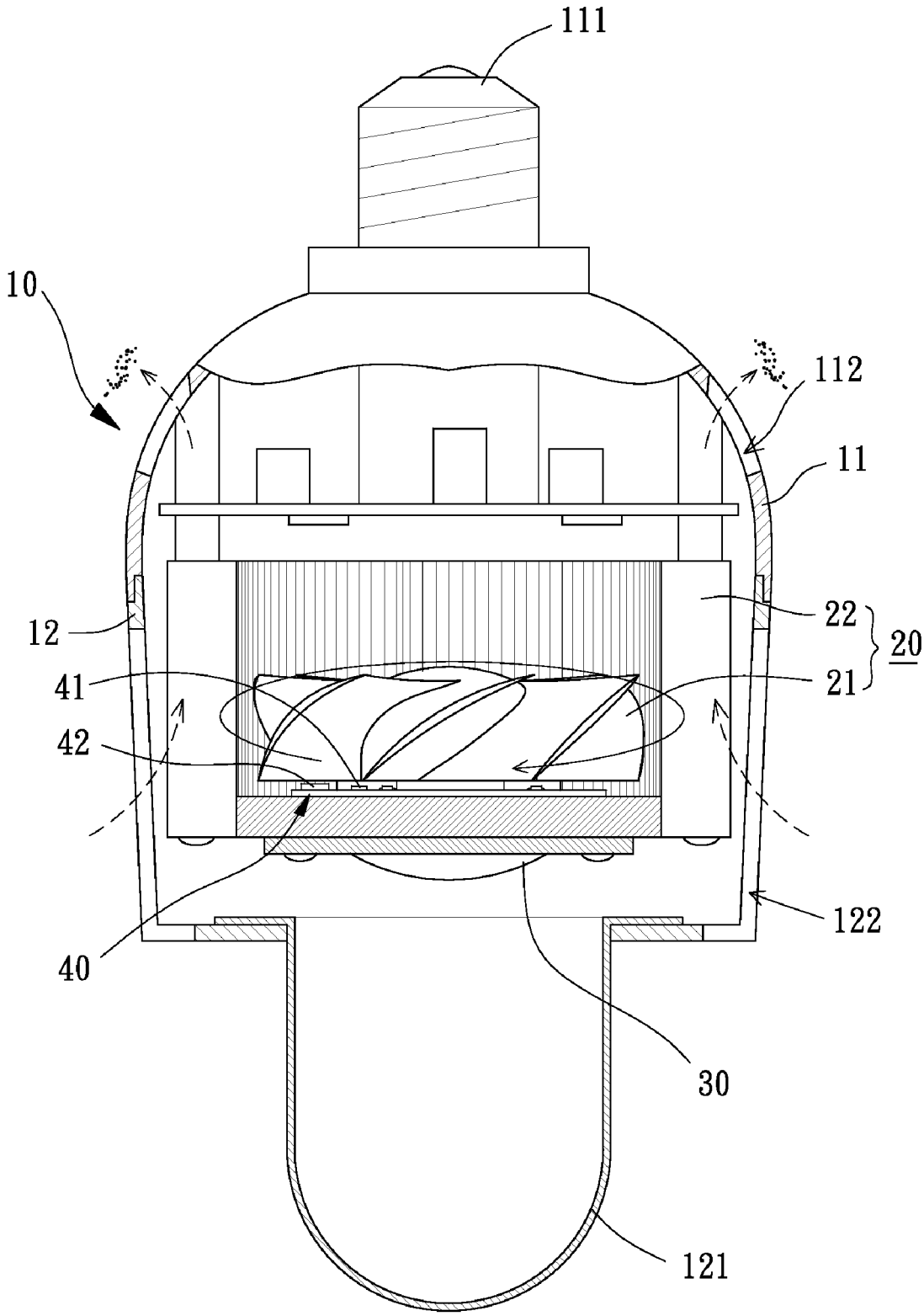
FIG. 3 shows cross sectional view of self-dusting lamp device of FIG. 1, illustrating the heat-dissipating fan rotating in a dusting direction for dusting down the housing.

A self-dusting lamp device according to the preferred teachings of the present invention is shown in FIGS. 1-3 of the drawings and generally includes a housing 10, a heat-dissipating module 20, a lighting element 30 and a controlling unit 40. The housing 10 can be a single housing or have two or more housing parts assembled together for receiving the heat-dissipating module 20, lighting element 30, controlling unit 40 and other elements of the self-dusting lamp device. Preferably, the housing 10 includes first and second housing parts 11, 12 assembled together as shown in FIGS. 1-3. The housing 10 has an electrical connection portion 111, that is, a base on an end and a light penetrating portion 121 on the other end. The housing 10 further includes an air inlet portion 112 and an air outlet portion 122 on the periphery thereof. Preferably, each of the air inlet portion 112 and air outlet portion 122 includes a plurality of openings or slots spaced in a circumferential direction of the first or second housing parts 11, 12.

The heat-dissipating module 20 is mounted in the housing 10. The heat-dissipating module 20 at least includes a heat-dissipating fan 21. Preferably, the heat-dissipating fan 21 is an axial-flow fan and is further coupled to a sink 22 made of heat conductive material for enhancing the heat-dissipating effect of the heat-dissipating module 20.

Preferably, the lighting element 30 is a light-emitting diode (LED), a bulb, or any element that can glow when being supplied with electricity. The lighting element 30 is coupled with the heat-dissipating module 20, preferably with a side of the sink 22 (as shown in FIG. 2). The lighting element 30 is electrically connected to the electrical connection portion 111.

The controlling unit 40 includes a driving circuit 41 and a direction controlling circuit 42 electrically connected to the driving circuit 41. The driving circuit 41 is electrically connected to the heat-dissipating fan 21 of the heat-dissipating module 20. Accordingly, the direction controlling circuit 42 controls the heat-dissipating fan 21 to rotate in a normal direction, or in a dusting direction opposed to the normal direction via the driving circuit 41. Besides, the driving circuit 41 and the direction controlling circuit 42 can be packaged into an integrated circuit (IC).

When the self-dusting lamp device is in use, the electrical connection portion 111 is coupled to a socket on a wall, a ceiling or a table (not illustrated) for supplying electricity to the lighting element 30 for providing illumination. Then, light emitted from the lighting element 30 passes through the light penetrating portion 121 to the environment. Moreover, the light penetrating portion 121 can be in various colors for the self-dusting lamp device to emit a colored light, e.g. green, yellow or red light.

Referring to FIG. 2, when the lighting element 30 is supplied with electricity to emit light and thus generate undesired heat, the direction controlling circuit 42 can control the heat-dissipating fan 21 to rotate in a normal direction via the driving circuit 41. Air is drawn from the environment via the air inlet portion 112 and then exhausted back to the environment via the air outlet portion 122, so as to form air currents passing through the housing. Therefore, the heat conducted by the sink 22 is transferred to the environment by the air currents to provide the desired heat-dissipating effect and, thus, prolong the life of the lighting element 30.

Referring to FIG. 3, while the heat-dissipating fan 21 lastingly draws the air into the hosing 10 via the air inlet portion 112 and cause the dust accompanying the air currents to accumulate on the air inlet portion 112, the direction controlling circuit 42 controls the heat-dissipating fan 21 to rotate in a dusting direction, which is a reverse of the normal direction. Based on the design of an impeller of the axial-flow fan, air flows through the housing 10 reversely; that is, the air is absorbed from the air outlet portion 122, passes through the housing 10, and is exhausted by the air inlet portion 112. While the air currents pass through the air inlet portion 112, the dust accumulated on the air inlet portion 112 is removed, and thus the air inlet portion 112 is prevented from being clogged to adversely decrease the amount of input air and the life of the lighting element 30 is further prolonged.

Specifically, the direction controlling circuit 42 regulates the timing for the heat-dissipating fan 21 to rotate in the normal or dusting direction alternatively by the driving circuit 41. For instance, while the self-dusting lamp device is initially actuated, the heat-dissipating fan 21 can rotate in the normal direction for a period of time (such as 10-20 seconds), and then rotate in the dusting direction for another period of time (such as 10-20 seconds) for dusting the housing 10 automatically. When the dusting is finished, the heat-dissipating fan 21 is regulated to rotate in the normal direction for dissipating heat. Alternatively, in another embodiment, while the self-dusting lamp device is initially actuated, the heat-dissipating fan 21 can rotate in the dusting direction for dusting the housing 10 automatically and then rotate in the normal direction for dissipating heat.

In summary, under control of the self-dusting lamp device according to the preferred teachings of the present invention, the heat-dissipating fan 21 is adjusted to rotate in a normal direction via the driving circuit 41 regulated by the direction controlling circuit 42 of the control unit 40, for conserving the heat-dissipating effect of the heat-dissipating fan 21. Meanwhile, the heat-dissipating fan 21 is adjusted to rotation in the dusting direction for providing the automatically self-dusting effect, preventing the air inlet portion 112 from being clogged to adversely decrease of the amount of input air. On the whole, the self-dusting lamp device according to the preferred teachings of the present invention provides the automatically self-dusting effect by the direction controlling circuit, and the heat-dissipating effect by the air drawn by the heat-dissipating fan 21 via the air inlet portion 112, for prolonging the life of the self-dusting lamp device.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A self-dusting lamp device comprising:

a housing having an electrical connection portion on an end of the housing and a light penetrating portion on the other end of the housing, with an air inlet portion and an air outlet portion on the outer periphery of the housing;

a heat-dissipating module being mounted in the housing and having a heat-dissipating fan;

a lighting element being coupled to the heat-dissipating module and being electrically connected to the electrical connection portion; and a controlling unit having a driving circuit electrically connected to the heat-dissipating fan and a direction controlling circuit electrically connected to the driving circuit for regulating the rotation direction of the heat-dissipating fan via the driving circuit, the rotation direction changing from one of a cooling direction and a dusting direction to the other of the dusting direction and the cooling direction after a first predetermined amount of time and back after a second predetermined amount of time.

2. The self-dusting lamp device as claimed in claim 1, wherein the heat-dissipating fan is an axial-flow fan.

3. The self-dusting lamp device as claimed in claim 1, wherein the heat-dissipating module further has a sink coupled to the heat-dissipating fan, and the sink has a side coupled to the lighting element.

4. The self-dusting lamp device as claimed in claim 3, wherein the air inlet portion including a plurality of openings spaced in a circumferential direction of the housing.

5. The self-dusting lamp device as claimed in claim 3, wherein the air outlet portion includes a plurality of openings spaced in a circumferential direction of the housing.

6. The self-dusting lamp device as claimed in claim 1, wherein the air inlet portion includes a plurality of openings spaced in a circumferential direction of the housing.

7. The self-dusting lamp device as claimed in claim 1, wherein the air outlet portion includes a plurality of openings spaced in a circumferential direction of the housing.

8. The self-dusting lamp device as claimed in claim 1, wherein the driving circuit and the direction controlling circuit are packaged into an integrated circuit.

* * * * *